US008184001B2

(12) United States Patent
Kuris et al.

(10) Patent No.: US 8,184,001 B2
(45) Date of Patent: May 22, 2012

(54) SMART DISPLAY DEVICE FOR INDEPENDENT LIVING CARE

(75) Inventors: Benjamin Kuris, Cambridge, MA (US); Steven M. Ayer, Marblehead, MA (US); Frank C. Bomba, Boston, MA (US); Doug F. Busch, Penryn, CA (US)

(73) Assignee: Intel-GE Care Innovations LLC, Roseville, CA (US)

( * ) Notice: Subject to any disclaimer, the term of this patent is extended or adjusted under 35 U.S.C. 154(b) by 375 days.

(21) Appl. No.: 12/316,415

(22) Filed: Dec. 12, 2008

(65) Prior Publication Data

US 2009/0184821 A1 Jul. 23, 2009

Related U.S. Application Data

(60) Provisional application No. 61/022,294, filed on Jan. 18, 2008.

(51) Int. Cl.
*G08B 1/08* (2006.01)

(52) U.S. Cl. ..... 340/539.3; 340/539.23; 340/539.25; 340/573.1

(58) Field of Classification Search ..... 340/541, 340/545.1, 545.4, 546, 547, 531, 539.1, 539.11, 340/540, 539.26, 506, 539.23, 539.25, 539.3, 340/573.1; 348/500, 564; 701/32, 33; 600/567; 715/863; 482/8
See application file for complete search history.

(56) References Cited

U.S. PATENT DOCUMENTS

| | | | | |
|---|---|---|---|---|
| 7,089,099 | B2 * | 8/2006 | Shostak et al. | 701/32 |
| 7,113,091 | B2 * | 9/2006 | Script et al. | 340/546 |
| 7,554,445 | B2 * | 6/2009 | Script et al. | 340/545.1 |
| 7,653,883 | B2 * | 1/2010 | Hotelling et al. | 715/863 |
| 7,733,224 | B2 * | 6/2010 | Tran | 340/540 |
| 2003/0130595 | A1 * | 7/2003 | Mault | 600/567 |
| 2005/0055710 | A1 * | 3/2005 | Aoki et al. | 725/32 |
| 2008/0058894 | A1 * | 3/2008 | Dewhurst | 607/54 |
| 2008/0077422 | A1 * | 3/2008 | Dooley et al. | 705/1 |
| 2008/0231449 | A1 * | 9/2008 | Moshfeghi | 340/572.1 |
| 2008/0294462 | A1 * | 11/2008 | Nuhaan et al. | 705/3 |

OTHER PUBLICATIONS

U.S. Appl. No. 12/284,326, Remotely Configurable Assisted-living Notification System With Gradient Proximity Sensitivity, filed on Sep. 19, 2008.

U.S. Appl. No. 12/058,998, "Context-Aware Medication Prompting (CAMP) Via Activity Beacon,", filed on Mar. 31, 2008.

U.S. Appl. No. 12/215,816, "Methods and Apparatus for Monitoring and Guiding Human Subjects Interacting with Objects", filed on Jun. 30, 2008.

Ware, Colin et al.,"Fish Tank Virtual Reality," 1993.

Hightower, Jeffrey, "Location Systems for Ubiquitous Computing," seattle.intel-research.net/people/jhightower/pubs/hightower2001location/hightower2001location.pdf, 2001.

* cited by examiner

*Primary Examiner* — Van T. Trieu

(74) *Attorney, Agent, or Firm* — Pillsbury Winthrop Shaw Pittman LLP

(57) ABSTRACT

A wireless contextual prompting device provides contextual (context-aware) prompting in the home for applications such as Activities of Daily Living (ADL) monitoring, medication adherence, journaling, social messaging and coaching. The device combines the advantages of a small, wireless, battery-operated sensor that may be easily mounted at critical places in a person's daily routine with a low-power, high-contrast display panel that may be palm sized. The context may be displayed on the display screen as images, icons and/or text such that it is easy to interpret warnings by the young, elderly, or the language-challenged.

23 Claims, 6 Drawing Sheets

SMART DISPLAY DEVICE FOR INDEPENDENT LIVING CARE

RELATED APPLICATIONS

This application claims the benefit of U.S. Provisional Application No. 61/022,294, filed on Jan. 18, 2008. The entire teachings of the above application are incorporated herein by reference.

FIELD

This disclosure relates to monitoring everyday human activities and in particular to a smart display device to monitor everyday human activities.

BACKGROUND

As the population ages, sensing and prompting devices are being developed to allow everyday human activities to be automatically inferred and provide assistance when appropriate. These sensing devices can support long term care while maintaining the independence valued by elders. Information about the daily activities of elders may be gathered remotely and provided to caregivers. Information about missed activities or changes in activity patterns may indicate that the elder is feeling ill. Caregivers can intervene when appropriate using a smart display, one example of a smart prompting device. The ability to monitor everyday activities may enable the elderly to continue living in their own homes as long as possible.

BRIEF DESCRIPTION OF THE DRAWINGS

Features of embodiments of the claimed subject matter will become apparent as the following detailed description proceeds, and upon reference to the drawings, in which like numerals depict like parts, and in which:

Although the following Detailed Description will proceed with reference being made to illustrative embodiments of the claimed subject matter, many alternatives, modifications, and variations thereof will be apparent to those skilled in the art. Accordingly, it is intended that the claimed subject matter be viewed broadly, and be defined only as set forth in the accompanying claims.

DETAILED DESCRIPTION

Monitoring of daily activities is especially important when a person is experiencing cognitive decline in order to provide feedback on their wellbeing. The feedback may be based on the detection of various activities such as ambulation, eating, and hygiene. Ambulation is typically monitored using wall mounted sensors or on-body kinematic sensors.

Eating and hygiene may be monitored by type or incidence of movement in food preparation, appliance-specific or bathroom fixture specific zones.

An embodiment of the present invention is wireless contextual prompting device for monitoring everyday human activities. Unlike a simple sensor, the prompting ability allows for user interaction when and where messages are most appropriate. In one embodiment the device is customizable. The device is designed for easy placement in a fixed location where it is likely that a person will be in the course of performing everyday human activities.

Figure 1:
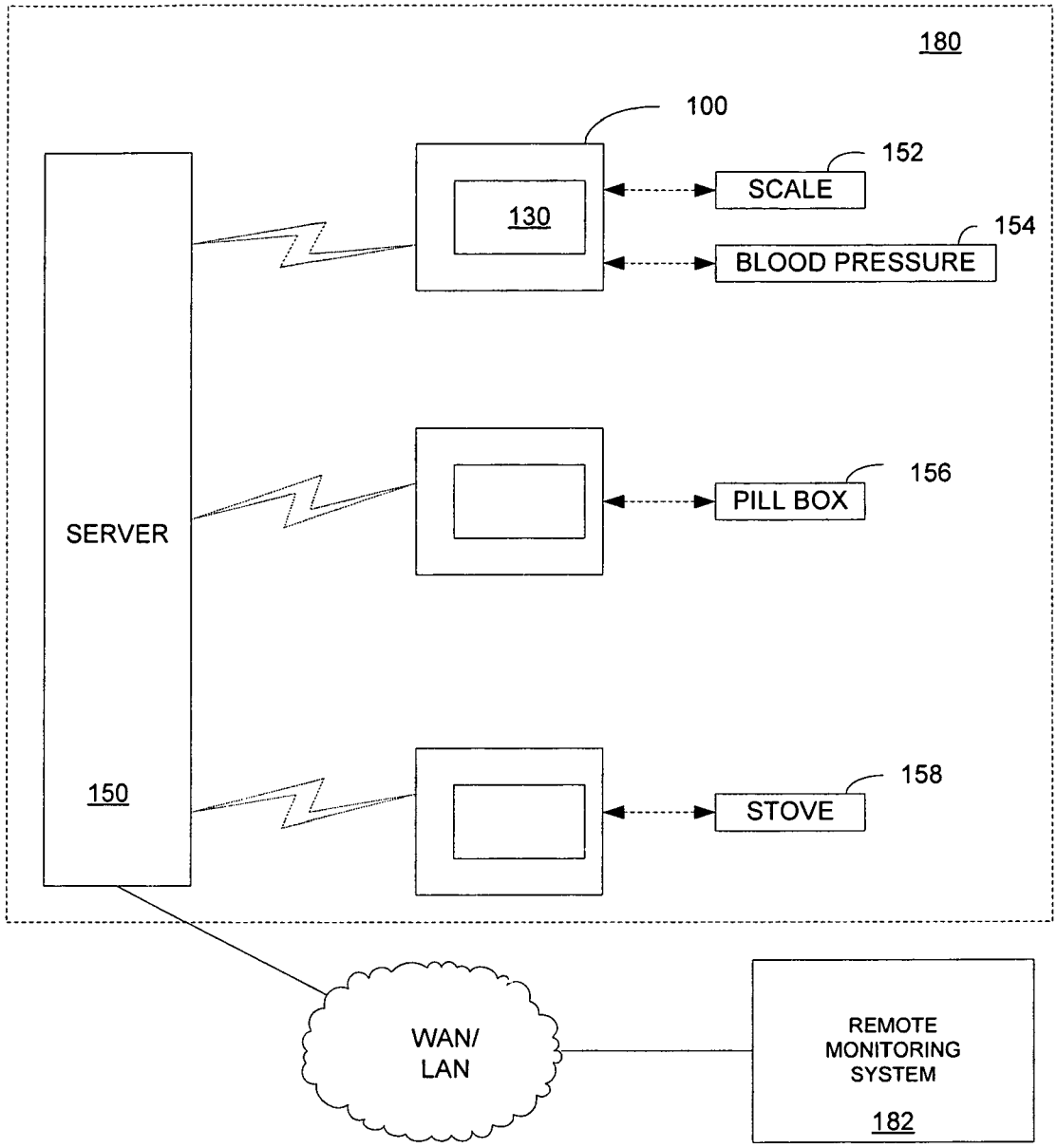
FIG. 1 illustrates an embodiment of a system that includes a wireless contextual prompting device according to the principles of the present invention.

FIG. 1 illustrates an embodiment of a system that includes a wireless contextual prompting device 100 according to the principles of the present invention. In an embodiment, the device 100 may provide contextual (context-aware) prompting in the home for applications such as Activities of Daily Living (ADL) monitoring, medication adherence, journaling, entertainment, social messaging and coaching by displaying information on a user interface output such as a display panel in the device 100. The system includes a server 150 that communicates with a plurality of wireless contextual prompting devices 100 over a wireless network in a home environment system 180. The system also includes a remote monitoring system 182 that communicates with the server 150 over a communications network. In the embodiment shown, the server 150 is located in the home.

Each of the plurality of wireless contextual prompting devices 100 may be configured for a particular context. For example, in a home environment, a wireless contextual prompting device 100 may be located in a bathroom (mounted on the bathroom wall), on the door of an appliance in the kitchen (for example, on the door of a refrigerator) and/or on each exterior door. Contextual prompting activities of the device are triggered upon detecting proximity of the person to the device or through other embedded motion sensing capabilities. Upon detecting motion of an object by the motion detector that is inferred to be a person, the device switches from a low-power state to an active state and may initiate contextual prompting based on location of the device and/or temporal factors.

The device 100 includes sensors that are capable of detecting both in-room motion and motion of the device itself. For ease of deployment, it is advantageous for the prompting device to run from an integrated power source (battery) to eliminate the aesthetic and mounting complexity of a power cable. The integrated motion sensors allow system components to awaken upon inferring presence (proximity) of a person due to detection of motion of an object in the field of view of the motion sensor. This reduces active-time for a display panel, wireless interface and microcontroller in the device and thus reduces power consumption of the device 100.

In the embodiment shown, one of the wireless contextual prompting devices 100 may be located in a bathroom and may be configured to monitor weight and teeth brushing based on monitoring a weighing scale 152 and a toothbrush 154. Another one of the wireless contextual prompting devices 100 may be located in a bedroom and may be configured to monitor medication based on monitoring pillbox 158. Yet another one of the wireless contextual prompting devices 100 may be located in a kitchen and may be configured to infer whether the person is eating and/or to remind the person to turn off appliances by monitoring whether a stove 158 is on or off.

Figure 2:
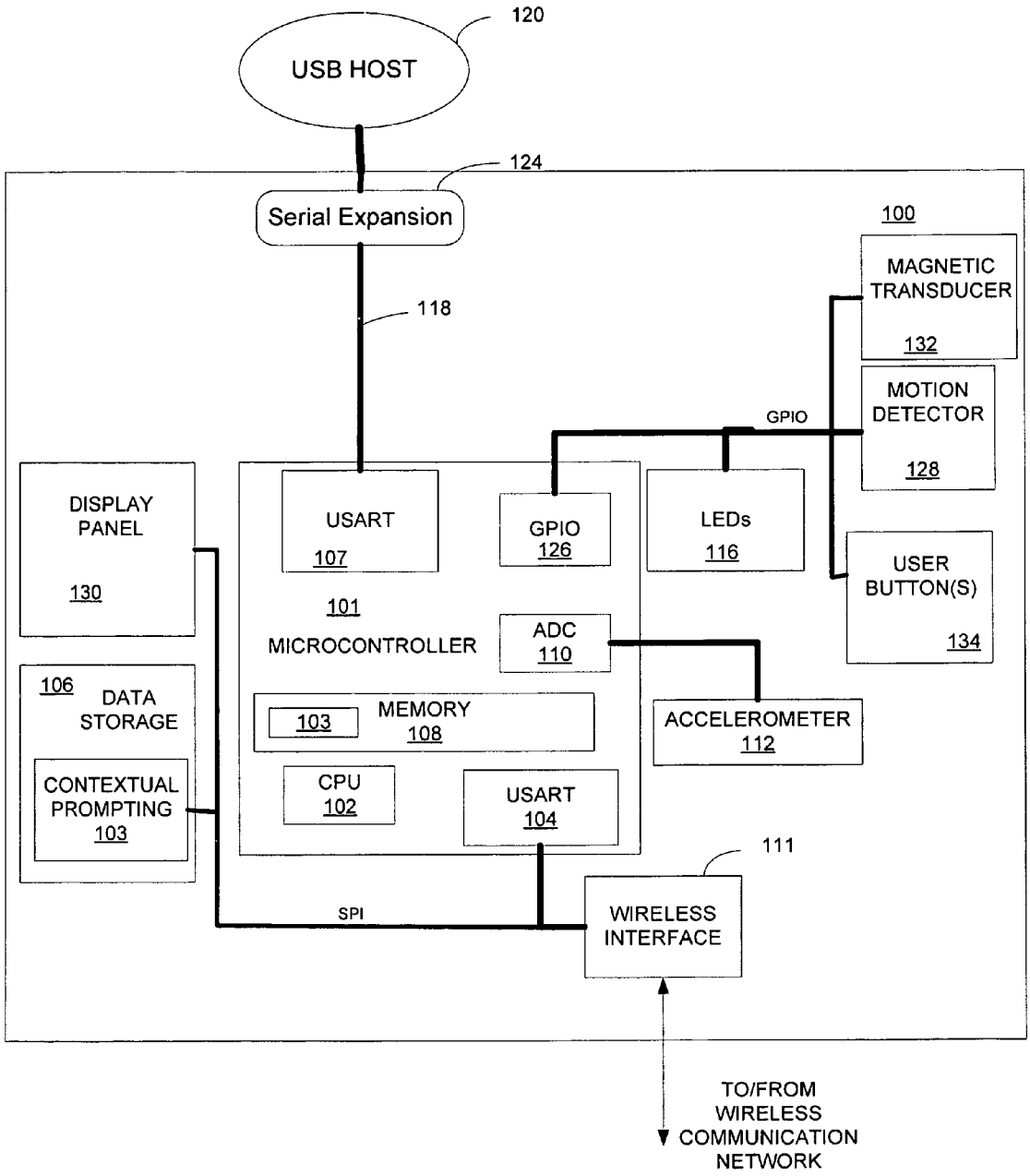
FIG. 2 is a block diagram of an embodiment of any one of the wireless contextual prompting devices shown in FIG. 1.

FIG. 2 is a block diagram of an embodiment of a wireless contextual prompting device 100 according to the principles of the present invention.

The device 100 includes a microcontroller 101 that controls the operation of the device 100 and communicates to various peripherals through internal and external expansion modules. In the embodiment shown in FIG. 1, the microcontroller 101 includes a General Purpose Input/Output Interface (GPIO) 126, an Analog-to-Digital converter (ADC) interface 110, two Universal Asynchronous/Synchronous Receive/Transmit serial communication (USART)s 104, 107 and memory 108. The ADC interface 110 is used to capture sensor data from one or more Analog-to-Digital converter (ADC) channels, one of which is shown coupled to an accelerometer 112. The accelerometer 112 may be used to detect motion of the device itself. The microcontroller 101 may also include a Central Processing Unit (CPU) 102 that may be a 16-Bit Reduced Instruction Set Computer (RISC) CPU.

In an embodiment, the memory 108 may include memory components such as Random Access Memory (RAM), or Flash memory (non-volatile memory). The Flash memory may store both data and instructions (code). The code stored in the Flash memory may include functions for contextual prompting 103.

The GPIO interface 126 provides an interface to I/O devices such as Light-emitting diodes (LEDs) 116. The LEDs 116 may be used as status indicators to indicate the current state of the sensing device 100 and/or provide an alert (for example, by flashing the LEDs on/off). Other I/O devices that may be coupled to the GPIO interface 126 include customizable user buttons 130 and a motion detector 128. In an embodiment, the motion detector 128 is a passive infra-red (PIR) spot-type motion detector. In other embodiments, the motion detector 128 may be a radio frequency (RF) proximity sensor such as a tag and reader or a capacitive proximity sensor. In yet another embodiment, the motion detector may be an imaging sensor such as light level or image capture or image differencing.

The USARTs 104, 107 enable serial peripheral interface (SPI) and asynchronous UART functionality. In an embodiment, a wireless network communications interface 111 is connected to the USART 104 using SPI mode. In an embodiment, the communications protocol may be Bluetooth® or any other wireless communications protocol. Wireless communication protocols such as, Bluetooth® may provide a range of 50 meters (m) or more from the server 150 over the wireless communication network. In an embodiment the wireless network communications interface may provide support for a Wide Area Network (WAN) and/or a Personal Area Network (PAN). A PAN has a smaller range (within a few meters from the device) than a WAN.

An optional memory device, for example, data storage 106 may be coupled to the microcontroller 101. In an embodiment the data storage 106 is a Flash memory, for example, MicroSD™ that implements a 1-bit Serial Peripheral Interface (SPI) mode with the SPI bus protocol used to communicate between the microcontroller 101 and the data storage 106. The SPI bus is a standard bus interface that includes bi-directional control and data signals such as Chip Select/Slave Select (SS), Master In Slave Out (MISO) and Interrupt Request (IRQ).

In other embodiments, the data storage 106 may be Compact Flash (CF) or Memory stick (a removable Flash memory card) or SmartMedia (also referred to as a Solid State Floppy Disk Card (SSFDC)) formats. The data storage 106 is provided in order to ensure that there is no loss of data while a direct current (D.C.) power source is interrupted, for example, while changing a battery.

In an embodiment, the device 100 may include a magnetic transducer 132 to provide an audible alert for tactile feedback and to draw users to the device 100.

The wireless communication interface provides the capability to provide accurate timekeeping and reporting of time-stamped motion events enhancing system-wide inference with context awareness. The wireless communication interface is capable of sending/receiving data and messages from the server 150.

The device 100 can also serve as a data aggregation device—in this role it will establish a data connections over a Personal Area Network (PAN) with proximal devices, such as pillboxes, wireless pulse-oximeters, wireless blood pressure cuffs, and weighing scales, and autonomously or via prompts aid the user in capturing measurements which are forwarded through the wireless communication interface to another device 100 or server 150.

Furthermore, an authorized remote user of a remote monitoring system 182 can both receive pertinent data regarding patient activity, and send messages to the device for display on the device via the wireless communication interface to the server 150 and another communications network to the remote monitoring system 182.

Figure 3:
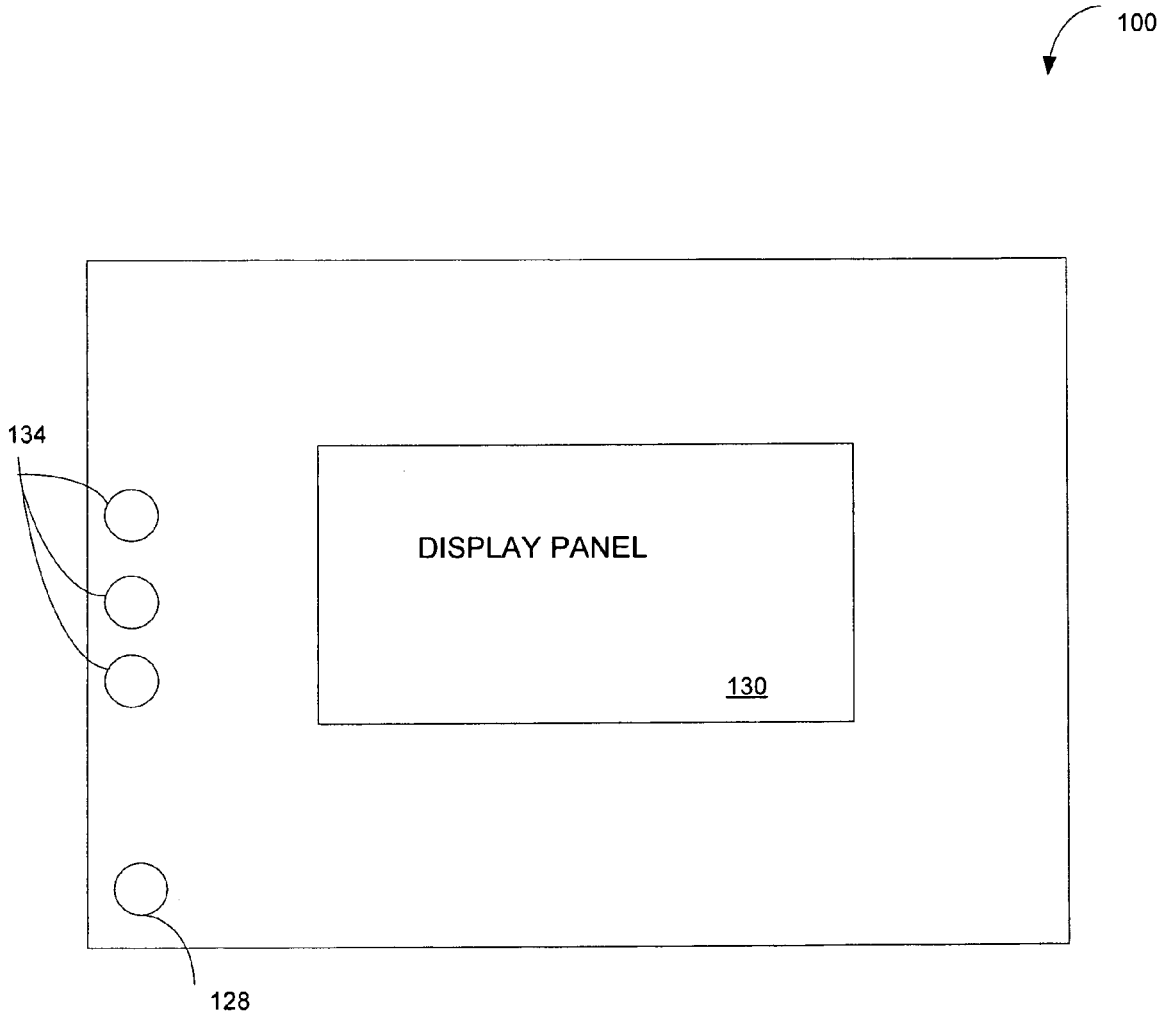
FIG. 3 is a top view of an embodiment of the wireless contextual prompting device shown in FIG. 2 comprising a display, a motion detector and a plurality of user buttons.

FIG. 3 is a top view of an embodiment of the wireless contextual prompting device 100 shown in FIG. 1 comprising a display panel 130, a motion detector 128 and a plurality of user buttons 130. The display panel 130 presents information in visual form. The display panel 130 may be a low-power, high-contrast display panel capable of easy daytime viewing. Low power consumption displays include Organic Light Emitting Diode (OLED) or Bi-stable display technology such as electronic paper (e-paper). Electronic paper a display technology that reflects light like paper, can display text and/or images with no power applied and allows the text and/or images to be changed. Examples of e-paper include Electrostatic (eInk), NanoChromics (NTERA) and BiNem (Nemoptic) and Cholesteric Liquid Crystal Display (ChLCD)-based flat panel displays.

However, the display panel 130 is not limited to OLED or e-paper displays. The display panel 130 may be any flat panel display with low-power consumption or any other type of display with low-power consumption that allows the device to be mounted on a wall.

In an embodiment, the display panel 130 is an OLED-based flat panel display that provides high contrast and a wide viewing angle with 4-bit grey scale image display and uses a write-only SPI interface. In another embodiment, the display panel 130 is a ChLCD-based flat panel display using bi-stable technology, that is, power is only consumed by the display when pixels are changed. The ChLCD-based flat panel display retains on-screen images even after the power has been turned off. The ChLCD-based flat panel display has a wide viewing angle with black and white image display and has an SPI interface.

Each user button 134 is a tactile input that may be a push button, that is, a small actuator that when force is applied closes an electric circuit. The closing of the electric circuit denotes selection of a function that may be mapped to the respective push button 134. In another embodiment the user button 134 may be a non-mechanical solid-state switch (capacitive, proximity, etc) or a touch panel.

The wireless contextual prompting device 100 may include mounting holes allowing it to be mounted on a wall, door or a home appliance. Power is supplied by a Direct Current (DC) power source included in the device 100. In an embodiment, the DC power source may be provided by a rechargeable battery that may be re-charged when necessary by supplying Alternating Current (AC) power through an AC power outlet with the appropriate power adaptor.

The device 100 has a plurality of operating modes, including a "low-power usage" mode and an active mode. The default mode of the device is "low power usage" mode in which power is only applied to a subset of components in the device 100 in order to support minimum functionality of the device. For example, to maintain low-power usage, the ADC interface 110 may be disabled when not in use and enabled only after inferring presence of a user based on the detection of motion by the motion detector 128.

The device 100 combines the advantages of a small, wireless, battery-operated sensor with a low-power, high-contrast display panel 130 to create a contextual prompting device that may be palm sized. In an embodiment, the display panel 130 is a 2.7 inch OLED display. The contextual prompting may be displayed on the display panel 130 as images or icons and/or text such that it is easy to interpret warnings by the young, elderly, or the language-challenged. Audio playback may also be used for messages that don't easily fit the size constraints of the display or as an aid for hearing or sight-challenged users. The audio may be included in the received context-aware content. The device may be easily mounted at critical places in a person's daily routine.

Figure 4:
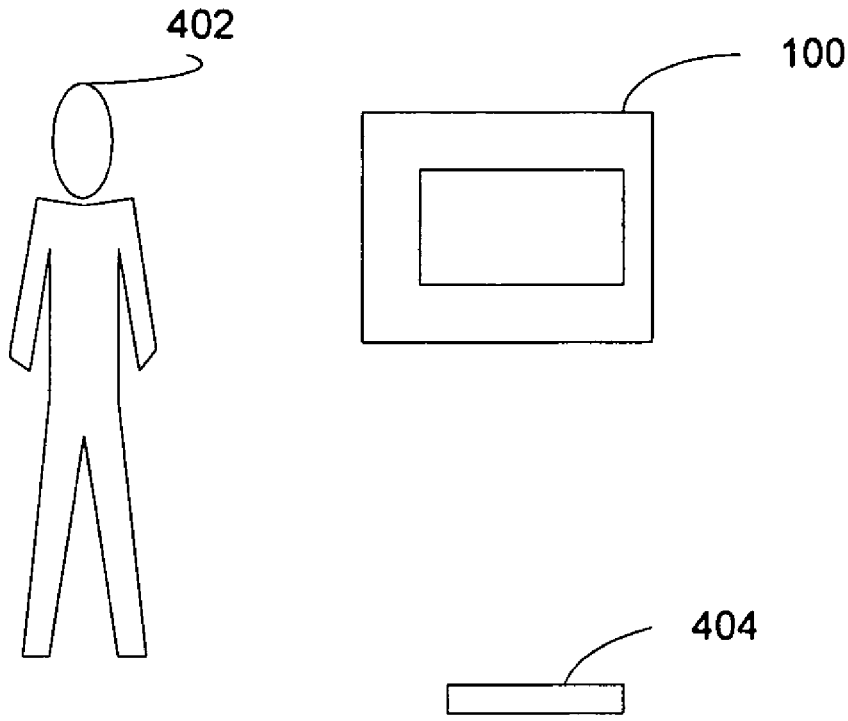
FIG. 4 illustrates an example of use of the wireless contextual prompting device shown in FIGS. 1-3 in a home environment.

FIG. 4 illustrates an example of use of the wireless contextual prompting device 100 shown in FIGS. 1 and 2 in a home environment. In the example shown, the device 100 is mounted on a wall in a bathroom and is configured for contextual prompting as a weighing scale remote monitor/data collector. The device 100 is capable of communicating via the wireless communication interface with the weighing scale 404 located on the floor of the bathroom. As the device 100 is capable of communicating with other devices such as the weighing scale 404, the device understands context resulting in meaningful system interactions.

The device 100 is in low-power state (idle) most of the time. The in-room motion due to detection of a person 402 in proximity to the motion detector 128 mounted on the device 100 is detected by the motion detector 128. The device 100 infers based on the detected in-room motion that a person 402 is in the bathroom and the device 100 is awakened (changes from idle state to active state) by the detection of motion by the in-room motion sensor 128.

Upon switching from idle state to active state, the device 100 may attempt to synchronize any local data such as current date/time information from a server 150 over the wireless network. Otherwise, the device will use locally stored time and event schedule. Upon receiving the current local date/time information and updates to scheduled events, the device 100 may determine based on the received current local date/time and entries stored in the system log that the person 402 is due to perform an activity. For example, the current local time/date may indicate that the person's weight is due to be recorded if the last recorded weight measurement stored in an entry in the local or remote system log was recorded over 24 hours ago. Therefore, by simple inference, the device 100 may display text, icons or pictures on the display panel and/or generate an audible alert to prompt the person to step on the weighing scale, so that the person's weight may be recorded. In an embodiment, the contextual prompting may include that the person confirm that he/she is the person being monitoring, by pressing one of the push buttons 134 on the device 100.

Figure 5:
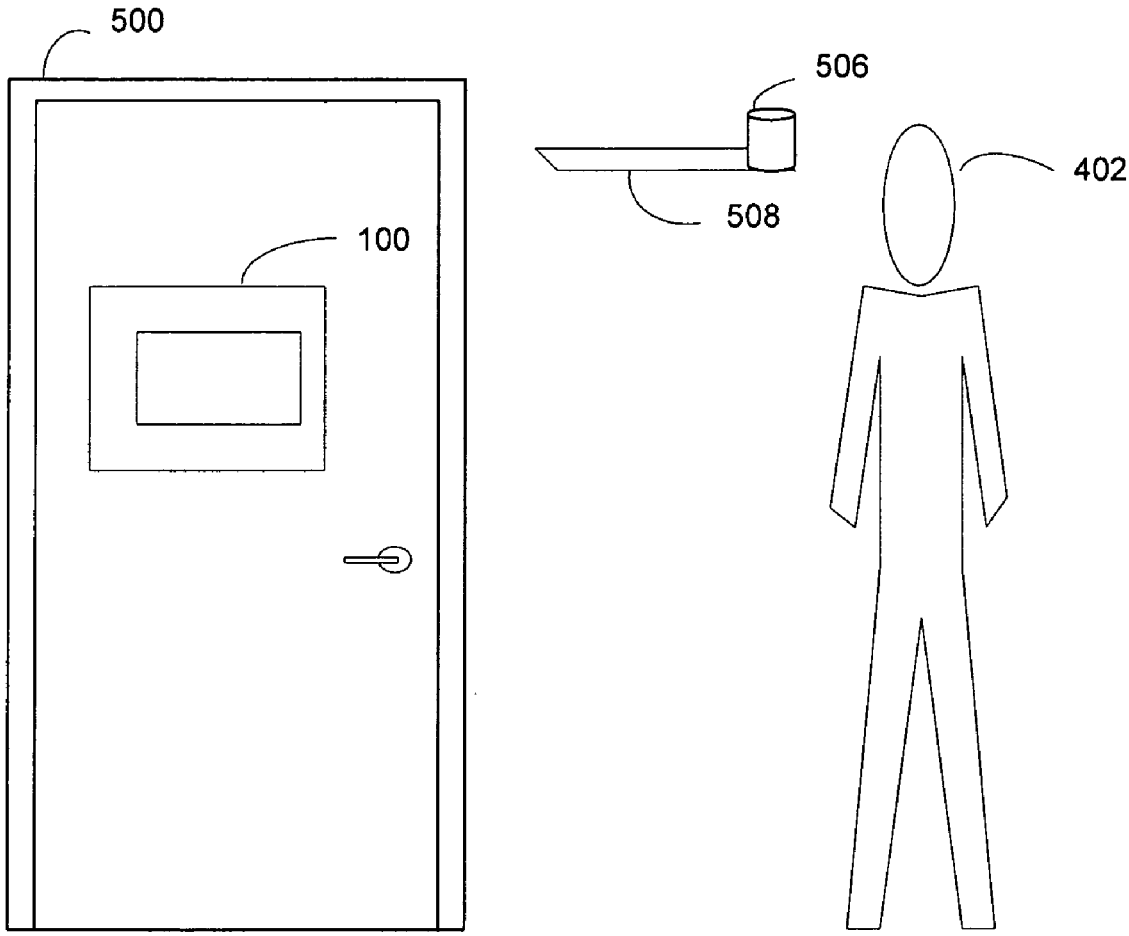
FIG. 5 illustrates another example of use of the wireless contextual prompting device shown in FIGS. 1-3 in a home environment.

FIG. 5 illustrates another example of use of the wireless contextual prompting device 100 shown in FIGS. 1 and 2 in a home environment. In the example shown, the device 100 is mounted on an exterior door 500. The device may be used to post reminders (pictures, icons and/or text) on the display panel prior to the person 402 exiting through the exterior door 400.

As the person 402 approaches the door 400, detection of in-room motion of the person by the in-room motion detector 128 awakens the device 100 as discussed in conjunction with FIG. 3. The device 100 checks the system log based on local current date/time for any activities that have not been completed. For example, the device 100 may check a smart pillbox 406 to infer whether medication has been taken. A smart pillbox typically has the ability to detect medication administration, and optionally confirm ingestion.

Sensors in the device 100 may gather context from any remote device over the wireless network, for example, from the smart pillbox 406 or an appliance such as a stove, refrigerator, or microwave that has the capability of communicating over a PAN. Therefore, the display panel 120 may display content indicating that stove is powered on.

For example, if the current local time is 2 A.M., the content displayed on the display panel may suggest to the person 402 that he/she should not leave through the exterior door because the person should be sleeping. In this case, the device 100 may alert a caregiver either in the home or in a remote location via the wireless network that the person is likely to exit through the exterior door. Furthermore, the motion of the door results in movement of the device detected by the accelerometer 112 in the device 100. This detected motion of the device itself may be used to infer whether the door 500 is open or closed. If the door 500 remains open after the person can no longer be detected by the motion detector, the device 100 itself, acting as a door open/closed sensor, may issue an audible alert to remind the person to close the door.

Thus, the device 100 may be used in a home environment for prompting/reminding a person about daily activities. For example, information about a task or appointment is communicated by displaying appropriate information on the display panel 130 of the device 100 upon inferring presence of a person 402 near the device. An audible alert may be used to draw the person's attention to the device to ensure that the information is received and that the person responds appropriately to the information. The response may be solicited by providing a soft mapping of the push buttons on the display to text on the display panel. For example, one button may be mapped to "yes", a second to "no" and a third to "OK". For example, if medication is to be taken twice daily and the person has not responded to the second inquiry indicating that the medication has been taken, an alert may be sent to a caregiver.

The device may also be used in a home environment for content delivery. For example, information of interest which may be delivered as text and/or graphics/pictures (bitmaps) may be received over the wireless network to be displayed on the display panel for the person while the person's presence is inferred by the motion detector, that is, while the person is at home and can view the display panel. The person may be required to interact with the device 100 by selecting one or more of the push buttons when prompted by the context displayed on the display panel to ensure that the displayed information has been viewed by the person.

The device 100 may also be used in a home environment for task review. For example, the user may request upcoming tasks for the day and in response a navigable list of tasks for the day that may be downloaded from a remote host may be displayed on the display panel. The device 100 may be reconfigured to alter its behavior without changing the basic functionality of any of its components.

Figure 6:
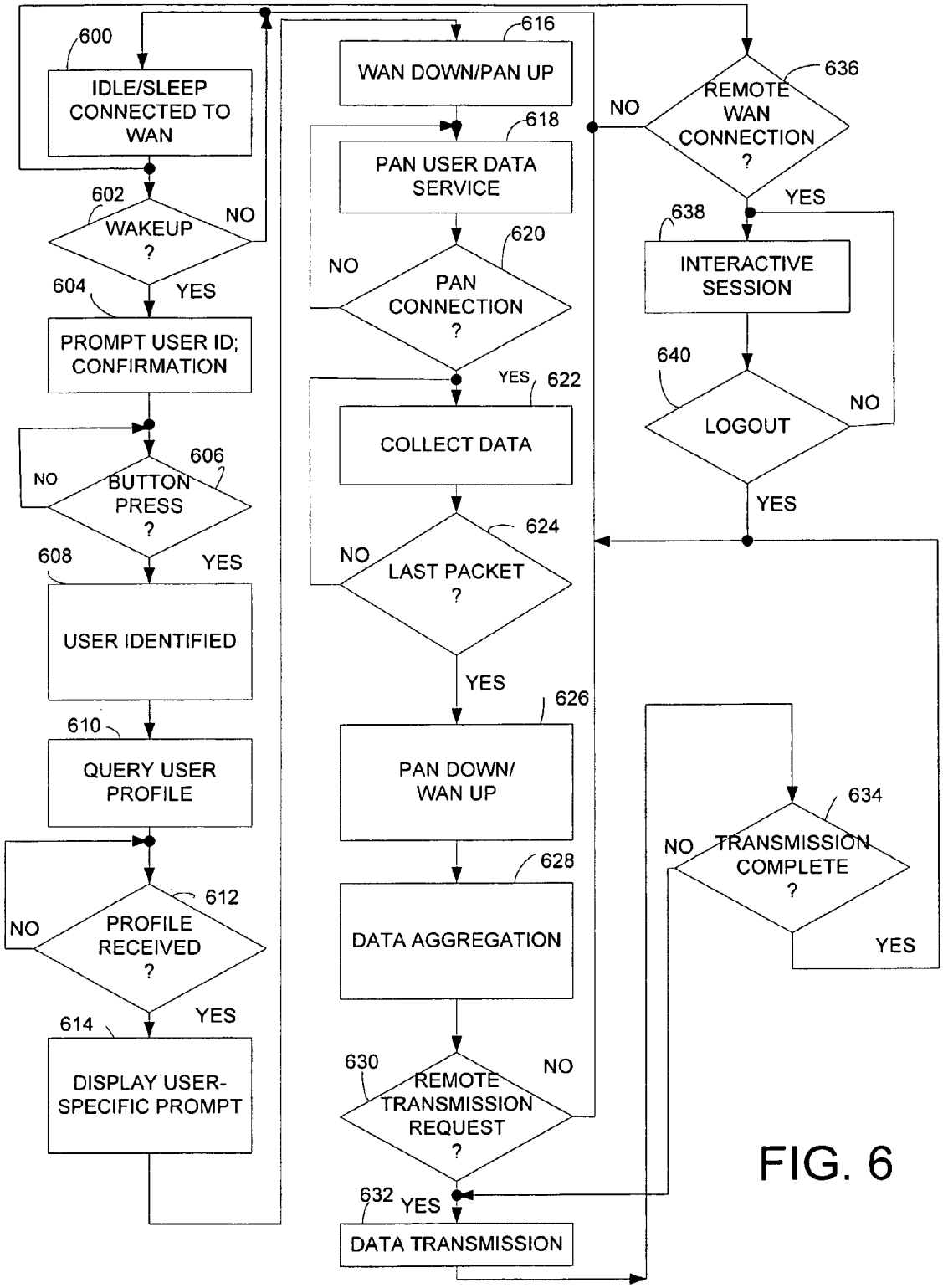
FIG. 6 is a flowgraph illustrating a method for contextual prompting that may be performed by any of the wireless contextual prompting devices shown in FIG. 1.

FIG. 6 is a flowgraph illustrating a method for contextual prompting that may be performed by any of the wireless contextual prompting devices shown in FIG. 1.

At block 600, the device is in a low power state (idle/sleep) and connected to a Local Area Network (LAN) and/or the Wide Area Network (WAN) via the server 150, that is, power is provided to the wireless interface and it is active. While the device is in idle/sleep mode, a request may be received from a remote WAN connection, for example, from the remote monitoring system 182 or any other system accessible via the WAN or in-room motion may be detected. Processing continues with block 602 to check for in-room motion or with block 636 to check for a request for a remote WAN connection.

At block 602, if motion is detected by the in-room motion detector 128, processing continues with block 604. If not, processing continues with block 600 with the device in idle/sleep mode.

At block 604, motion has been detected by the in-room motion detector 128. The device 100 infers that the detected motion is due to a person and displays text on the display panel 130 to confirm presence of a person and that the person is the person to be monitored. For example, the text displayed on the display panel 130 may be to prompt the person to confirm a user identification. Processing continues with block 606.

At block 606, the device waits for the person to press a button to confirm the user identification. If the button is pressed, processing continues with block 608. If not, processing continues with block 606.

At block 608, the user is identified, processing continues with block 610.

At block 610, a request is sent to the host server to obtain a profile for the identified user. Processing continues with block 612.

At block 612, if the user profile has been received processing continues with block 614. If not, processing remains in bloc 612, until the user profile is received.

At block 614, a user specific prompt is displayed on the display panel 130. For example, the user specific prompt may be "Please step on the weighing scale". Processing continues with block 616.

At block 616, the device 100 the interface to the WAN is no longer active. Instead, the device 100 may communicate with any sensing device that is accessible via the Personal Area Network (PAN) which is active. Processing continues with block 618.

At block 618, the device 100 performs a user data service over the Personal Area Network user. For example, data may be acquired over the PAN from a sensing device dependent on the confirmed user identification. Dependent on the user, the user data service may be to prompt the user to take his/her temperature or to step on the weighing scale. Dependent on the particular data service, the device 100 anticipates receiving a specific type of data over the PAN, for example, temperature data or weight data.

Processing Continues with Block 620

At block 620, if there is a PAN connection, processing continues with block 622. If not, processing remains in bloc 620 waiting for a PAN connection.

At block 622, data is collected from the sensing device, for example, the weighing scale. Processing continues with block 624.

At block 624, if the last packet has been received from the sensing device, processing continues with block 626. If not, processing continues with block 622 to continue to collect data.

At block 626, the PAN is down (inactive), and the WAN is up (active). Processing continues with block 628.

At block 628, the collected data is aggregated. Processing continues with block 628.

At block 630, if there is a remote transmission request, that is, a request to transmit the aggregated data to the host server, processing continues with block 632. If not, processing continues with block 600.

At block 632, the aggregated data is transmitted to the host server. Processing continues with block 634.

At block 634, if the transmission is complete, processing continues with block 600. If not, processing continues with block 634 to transmit the data.

At block 636, if there is a request for a remote WAN connection, processing continues with block 638. If not, processing continues with block 600.

At block 638, there is an interactive session between the device 100 and another device accessible via the WAN. Processing continues with block 640.

At block 640, if there is a request to end the remote WAN connection, processing continues with block 640. If not processing continues with block 638.

An embodiment has been described for monitoring daily activities of elders in a home environment. However, the invention is not limited to monitoring activities of elders. Other embodiments may be used for chronically ill, to reinforce lifestyle changes based on coaching and/or dieting, or clinical use, for example, patient workflow management. For example, the device may also be used by the caregivers of the chronically ill as a customizable monitoring aid that can be based on the caregiver's context. For example, as the caregiver is leaving their house in the morning, a wireless contextual prompting device on the door of the caregiver's house may prompt "While out, check on Grandma—unusually low activity levels today."

An embodiment has been described for a device that includes a display panel to provide a user interpretable output based on received context aware content that is active only after the motion of the object has been detected. In other embodiments, the device may not include a display panel instead of displaying user interpretable output (text, icons and/or images) on a display panel, the user interpretable output may be provided to another user interface output device, for example, as audio to a speaker or to an image projector to be projected on a wall in the home. In order to reduce power consumed by the device while inactive, the speaker may be in an inactive state until after the motion of the object has been detected.

Alternative embodiments of the invention also include machine-accessible media containing instructions for performing the operations of the invention. Such embodiments may also be referred to as program products. Such machine-accessible media may include, without limitation, storage media such as floppy disks, hard disks, Compact Disk-Read Only Memories (CD-ROMSs), Read Only Memory (ROM), and Random Access Memory (RAM), and other tangible arrangements of particles manufactured or formed by a machine or device. Instructions may also be used in a distributed environment, and may be stored locally and/or remotely for access by single or multi-processor machines.

While embodiments of the invention have been particularly shown and described with references to embodiments thereof, it will be understood by those skilled in the art that various changes in form and details may be made therein without departing from the scope of embodiments of the invention encompassed by the appended claims.

The invention claimed is:

1. An apparatus comprising:

a motion sensor configured to detect motion of an object in a field of view of the apparatus;

a wireless communication network interface configured to receive dynamic context-aware content in response to the detection motion; and a user interface output device configured to provide a user interpretable output based on the received context-aware content, wherein the user interface output device shifts from a low-power state to an active state only after presence of the object has been detected with the motion sensor being stationary, and wherein upon the shift from the low-power state to the active state, a request is sent to synchronize local data and obtain profile information.

2. The apparatus of claim 1, further comprising:

an interface to receive sensed data from a sensing device over a personal area network after the motion of the object has been detected.

3. The apparatus of claim 1, further comprising:

a tactile input to allow a user to provide user input based on content displayed on the display panel.

4. The apparatus of claim 1, wherein the display panel is an Organic Light Emitting Diode (OLED).

5. The apparatus of claim 1, wherein the display panel is electronic paper.

6. The apparatus of claim 1, wherein the user interface output device comprises a screen configured to provide the user-interpretable output as a displayed text, icon, image, or combination thereof.

7. The apparatus of claim 6, wherein the user interface output device comprises a speaker configured to provide the user-interpretable output as audio output, and wherein the apparatus is configured to determine whether the user-interpretable output fits the screen and is configured to provide the user-interpretable output as audio output if the context-aware content is determined to not fit the screen.

8. The apparatus of claim 1, wherein the motion sensor is a passive infra-red (PIR) spot-type motion sensor, a capacitive proximity sensor, a radio frequency proximity sensor, an imaging sensor, or any combination thereof.

9. The apparatus of claim 1, wherein a mounting hole is provided on the apparatus, the mounting hole configured to allow the apparatus to be mounted on a wall, a door, a home appliance, or any combination thereof.

10. The apparatus of claim 1, further comprising an accelerometer, wherein the apparatus is configured to detect an opening of a door based on an indication from the accelerometer, and wherein the user interface output device is configured to present, based on detecting the opening of the door and based on the time of day, an indication to the user that he or she should not leave through the door.

11. The apparatus of claim 1, further comprising an analog-to-digital converter interface, wherein the apparatus is configured to disable the analog-to-digital converter interface when presence of the user has not been detected.

12. The apparatus of claim 1, wherein the motion sensor, wireless communication network interface, and user interface output device are at least partially housed in a housing of the apparatus.

13. A method comprising:

detecting presence of a user based on detecting motion of an object with a motion sensor;

receiving dynamic context-aware content in response to the detected presence;

activating a user interface output device only after the presence of the user has been detected with the motion sensor being stationary; and providing a user interpretable output through the user interface output device based on the received context-aware content and based on a location of the user interface output device in a home environment and based on a time of day.

14. The method of claim 13, further comprising:

receiving sensed data from a sensing device over a personal area network after the motion of the object has been detected.

15. The method of claim 13, further comprising:

allowing a user to provide user input based on content displayed on the display panel.

16. The method of claim 13, further comprising determining whether the user-interpretable output fits a screen of the user interface output device;

providing the user-interpretable output as a displayed text, icon, image, or combination thereof if the user-interpretable output is determined to fit the screen; and providing the user-interpretable output as audio output if the user-interpretable output is determined to not fit the screen.

17. The method of claim 13, wherein power is applied to the user interface output while the user interface output is activated.

18. An apparatus comprising:

a motion sensor configured to detect motion of an object in a field of view of the apparatus;

a wireless communication network interface configured to receive dynamic context-aware content in response to the detection motion; and a user interface output device configured to provide a user interpretable output based on the received context-aware content, wherein the user interface output device shifts from a low-power state to an active state only after presence of a user has been detected with the motion sensor being stationary.

19. The apparatus of claim 18, wherein the user interpretable output includes a reminder of a scheduled activity.

20. The apparatus of claim 18, wherein the user interpretable output is based on a time of day and a location of the apparatus within a dwelling.

21. The apparatus of claim 20, wherein the apparatus is configured to communicate with a remote caregiver via the wireless communication network interface.

22. A system comprising:

an apparatus having a housing that at least partially houses:

a motion sensor configured to detect motion of an object in a field of view of the apparatus;

a wireless communication network interface configured to communicate dynamic context-aware content to the user interface output device, a user interface output device configured to provide a user interpretable output based on the dynamic context-aware content, wherein the user interface output device shifts from a low-power state to an active state only after presence of a user has been detected with the motion sensor being stationary;

the system further comprising a second sensor configured to communicate wirelessly with the apparatus, wherein the context-aware content is based on an output from the second sensor.

23. The system of claim 22, wherein the second sensor is coupled to an appliance, the second sensor configured to communicate a state of operation of the appliance to the wireless communication network interface of the appliance.

* * * * *